US007954179B2

(12) United States Patent
Johnson et al.

(10) Patent No.: US 7,954,179 B2
(45) Date of Patent: Jun. 7, 2011

(54) WATER CLOSET BOLT

(76) Inventors: Charles W. Johnson, Racine, WI (US); Andrew R. Johnson, Racine, WI (US)

( * ) Notice: Subject to any disclaimer, the term of this patent is extended or adjusted under 35 U.S.C. 154(b) by 802 days.

(21) Appl. No.: 11/670,211

(22) Filed: Feb. 1, 2007

(65) Prior Publication Data

US 2008/0184469 A1 Aug. 7, 2008

(51) Int. Cl.
*E03D 11/14* (2006.01)

(52) U.S. Cl. ..... 4/252.1; 411/5; 411/417; 411/419

(58) Field of Classification Search ..... 4/252.1, 4/252.2, 252.3, 252.4, 252.5, 252.6; 411/104, 411/107, 402, 403, 410, 418, 419, 395, 407, 411/408; 441/104, 107, 402, 403, 410, 418, 441/419

See application file for complete search history.

(56) References Cited

U.S. PATENT DOCUMENTS

| | | | | |
|---|---|---|---|---|
| 0,927,611 | A | 7/1909 | Stallings | |
| 0,952,602 | A | 3/1910 | Candee | |
| 1,055,330 | A | 3/1913 | Kling | |
| 1,093,434 | A * | 4/1914 | Kent | 220/243 |
| 1,507,488 | A | 9/1924 | Kraemer | |
| 1,813,790 | A | 7/1931 | Wildish | |
| 3,125,765 | A | 3/1964 | Fay | |
| 3,329,057 | A | 7/1967 | Salz | |
| 3,339,215 | A | 9/1967 | Flood | |
| 3,346,286 | A | 10/1967 | Wescott | |
| 3,601,823 | A | 8/1971 | Isaacs | |
| 3,669,171 | A | 6/1972 | Yavitch | |
| 3,725,979 | A | 4/1973 | Otsuru | |
| 3,775,780 | A | 12/1973 | McEwen | |
| 3,846,851 | A | 11/1974 | Pepper | |
| 3,896,510 | A | 7/1975 | O'Connell | |
| 4,212,486 | A | 7/1980 | Logsdon | |
| 4,233,697 | A | 11/1980 | Cornwall | |
| 4,530,629 | A | 7/1985 | Sakow | |
| 4,574,402 | A | 3/1986 | Brown, Sr. | |
| 4,700,437 | A | 10/1987 | Hoshino | |
| 4,780,915 | A | 11/1988 | Cuschera | |
| 4,827,539 | A | 5/1989 | Kiziah | |
| 4,907,923 | A | 3/1990 | McGrath | |
| 6,125,479 | A | 10/2000 | Fraleigh | |
| 6,270,304 | B1 | 8/2001 | Freedland | |
| 6,430,756 | B1 | 8/2002 | Reilly | |
| 6,698,986 | B2 | 3/2004 | Fraleigh | |
| 7,043,878 | B2 | 5/2006 | Cardine et al. | |
| 2001/0008600 | A1 | 7/2001 | Fraleigh | |

* cited by examiner

*Primary Examiner* — Gregory L Huson
*Assistant Examiner* — Janie Christiansen
(74) *Attorney, Agent, or Firm* — Boyle Fredrickson, S.C.

(57) ABSTRACT

A water closet bolt comprises an upper end and a lower end with a threaded body extending therebetween. The lower end includes an oblong foot and the upper end includes a male or female notch for visually indicating the orientation of the long axis of the oblong foot. The notch also serves as a gripping surface to aid the installer in the installation of the toilet. Furthermore, the bottom of the notch acts as a break-off point to aid the installer in removing an excess portion of the bolt after the completing the installation.

19 Claims, 2 Drawing Sheets

WATER CLOSET BOLT

BACKGROUND OF THE INVENTION

1. Field of the Invention

The invention relates to a water closet bolt for use in installing a toilet and, more particularly, relates to a water closet bolt that has a notch that indicates the orientation of the long axis of a foot of the water closet bolt. The notch also provides a surface that serves as a hold-back for the user during installation and provides a break-off point to aid in the removal of an excess end portion of the bolt.

2. Discussion of the Related Art

Toilets are typically mounted in place using vertical bolts that extend upwardly from a bottom surface of circular flange or collar in the toilet. These bolts, known in the trade as "water closet bolts," typically comprise an oblong foot which serves to engage an upper surface of the collar. The bolt is configured to fit securely under one of two sets slots in the collar. The first set is arcuate and is enlarged at one end. A bolt can be inserted into one of these slots by inserting it into the enlarged end with the foot extending generally parallel to the slot. The bolt is then slid to the narrow end of the slot and rotated so that the long axis of the foot extends perpendicular to the slot and, thus, cannot be pulled upwardly through the slot. The slots of the second set are, more precisely, notches extending radially inwardly from the outer perimeter of the collar. During installation the bolt is slid radially into the notch from the outside and, if necessary, rotated so the bolt so that the long axis of the foot is perpendicular to the notch.

The subsequent mounting of the toilet involves placing a wax sealing ring over the collar and manually lowering the base of the toilet such that the bolts extend through the sealing ring and vertical apertures in the base. After the toilet is lowered over the bolts, nuts or other threaded or thread-compatible fasteners are tightened downwardly onto the upper ends of the bolts and against the base of the toilet, thus drawing the upper surface of the feet against the bottom surface of the collar and clamping the toilet in place.

One of the principal difficulties in the installation of the toilet is ensuring that the oblong feet of the bolts are oriented correctly when the nuts are tightened onto the bolts. If a bolt becomes turned during the lowering of the toilet base or tightening of the nut on the bolt, the foot can become aligned with the slot in the collar, permitting the foot to be pulled upwardly through the slot. If this happens, the toilet will not be securely fastened to the floor, which will cause the toilet to rock rather than sit securely on the floor and cause sewer gas and water to leak at the base.

Another difficulty arising during toilet installation is the lack of a non-threaded hold back surface for the bolts during the installation. During the installation process, the user must grip the bolt with a pliers or a similar tool to ensure that the bolt remains in the correct position when the nut is threaded onto the bolt. The threads of the bolt may be damaged during the installation process because the user will be required to grip the threads of the bolt during installation. As such, it may become difficult or impossible for the user to screw a nut or cap over the threads of the bolt once the threads have become damaged or to remove the nut. Thus, a bolt with damaged threads may have to be discarded and replaced with another bolt.

A further problem encountered during toilet installation is the need to remove an excess portion of the bolt once the toilet has been completely installed. Typically, the bolts used in installation are too long to properly receive commonly used plastic or ceramic caps over them. Therefore, it is necessary to break off an excess portion of the bolt in order to properly secure the cap over the remaining portion of the bolt. Oftentimes, the removal of the excess portion proves to be quite difficult and may require the use of a hacksaw or a great deal of force that may result in chipping or cracking of the porcelain. The application of too much force may also result in the tool slipping and striking the base of the toilet, thus possibly chipping the porcelain of the toilet being installed.

The so-called "Johnny Bolt" or "Johnny Style Bolt" is the most commonly used type of water closet bolt. The Johnny Style bolt typically has an oblong foot configured to fit within the arcuate slot of a flange or collar. The Johnny Style Bolt further provides a break off point located at a predetermined, industry standard location near the upper end of the bolt. The break-off point is formed from a circular groove formed in the outer periphery of the bolt. By breaking the bolt at this point after the nut is installed, a standard ceramic or plastic cap may fit over the remaining exposed portion of the bolt. A bolt of this type is disclosed in U.S. Pat. No. 4,530,629 to Sakow, the subject matter of which is hereby incorporated by reference.

It is therefore a principal object of the present invention to provide a water closet bolt for use in installing toilets that would visually indicate to the user the orientation of the long axis of the oblong foot of the bolts, provide a hold-back position to aid the user in installation and provide a break-off point to ease the removal of an excess portion of the bolt after the toilet is secured over the bolts.

SUMMARY OF THE INVENTION

A water closet bolt has a visual indicator of the orientation of the long axis of an oblong foot of the water closet bolt on an upper end of the bolt. The visual indicator may comprise a male or female notch. The notch further provides a surface to serve as a hold-back to aid the user during the installation of the toilet. In addition, the end of the notch serves as a break-off point, which enables a user to easily remove an excess portion of the end of the bolt so as to enable the user to secure a cap over the remaining portion of the bolt. Use of the water close bolt saves the installer time and assists in the proper installation of the toilet, thus eliminating callbacks.

These and other advantages and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Figure 1:
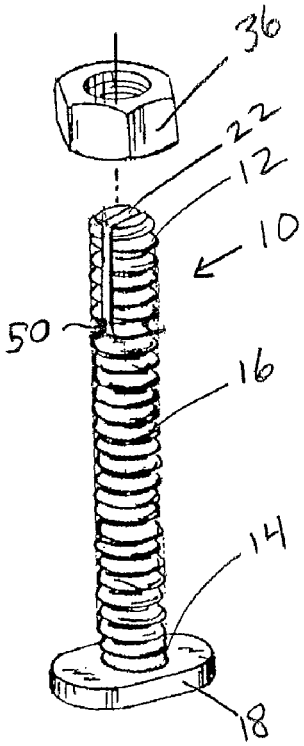
FIG. 1 is a perspective view of a water closet bolt constructed in accordance with a first preferred embodiment of the present invention.
Figure 2:
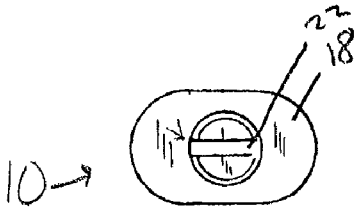
FIG. 2 is a top plan view of the water closet bolt of FIG. 1.

Turning now to the drawings and initially to FIGS. 1-2, a water closet bolt 10 for use in installing a toilet is illustrated that includes an upper end 12 and a lower end 14 and that has a threaded body 16 extending therebetween. The lower end 14 terminates in substantially oblong foot 18. The upper end 12 includes a notch.

In a first preferred embodiment, the notch comprises a female notch 22. The female notch 22 is configured to provide a visual indication of the orientation of the oblong foot 18. For instance, the female notch 22 may be substantially parallel to the long axis of the oblong foot 18 as shown. Alternatively, the female notch 22 may be substantially perpendicular to the long axis of the oblong foot 18.

The bottom of the notch 22 serves as a break-off point for the bolt 10. After toilet installation, the break-off point should be located above the top of the nut but beneath the top of the cap of the installed toilet. It preferably but not necessarily coincides with the location of the peripheral notch on a standard Johnny Bolt. The top-down depth to that location (and hence the initial length of the bolt) is less important than the final length of the bolt after the notched extension is broken off. A top-down depth of a ½" inch is currently preferred, ±¼". The initial and final lengths of the threaded portion 16 of the bolt 10 for three standard bolt lengths is identified in Table 1 below:

TABLE 1

| Bolt Lengths | |
|---|---|
| Initial Length | Final Length After Break-Off |
| 2¼" | 1¾" |
| 2½" | 2" |
| 3½" | 3" |

Flanking surfaces of the notch 22 also provide a "hold back" surface that permits a screwdriver or similar tool to be inserted into the notch 22 to hold the bolt 10 from rotating out of its desired orientation while tightening a nut onto the bolt with a separate tool such as a wrench. A notch width of between 0.010 to 0.150 inches is preferred for receiving such a tool. In the case of a ¼" to 5/16" diameter bolt the depth desired for the break-off point is more than adequate for receiving such a tool.

Figure 3:
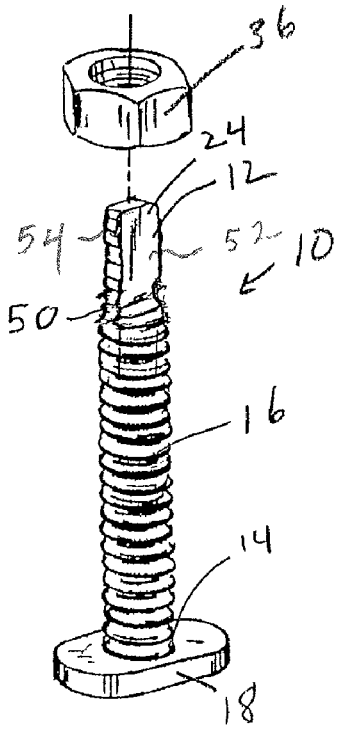
FIG. 3 is a perspective view of a water closet bolt constructed in accordance with a second preferred embodiment of the present invention.
Figure 4:
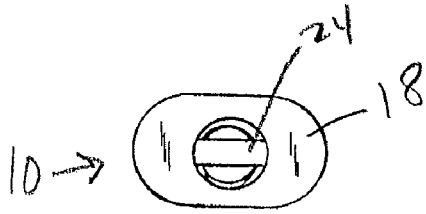
FIG. 4 is top plan view of the water closet bolt of FIG. 3.

Turning now to FIGS. 3 and 4, a second preferred embodiment of the present invention is shown wherein the notch is a male notch 24. The male notch 24 has relatively wide flat sides 52 that are separated by relatively narrow arcuate sides 54. It, like the female notch 22, is preferably centered on the axial centerline of the bolt 10. The male notch 24 serves all of the same orientation indication, hold-back facilitation, and break-off facilitation functions of the female notch 22 described above. It therefore has a width (i.e., length of sides 54) that equals that of the corresponding female notch, preferably 0.010 to 0.150 inches wide for a ¼" to 5/16 diameter bolt. Its depth for "standard" length bolts is also preferably the same as that identified in Table 1 above.

The upper end of the bolt 10 is threaded in order to permit the nut to be threaded onto the extreme upper end of the bolt. In the case of a female notch 22, the entire remaining periphery of the notched end is preferably threaded as best seen in FIG. 1. In the case of a male notch 24, the opposed relatively narrow sides 54 are threaded as best seen in FIG. 3.

Breaking the bolt 10 at the break off point can be facilitated for either male or female notches 22 or 24 by incorporating a peripheral groove 50, similar or even identical to the grooves found in Johnny Bolts, at the break off point. Such a groove should be about 3/16" deep.

Figure 5:
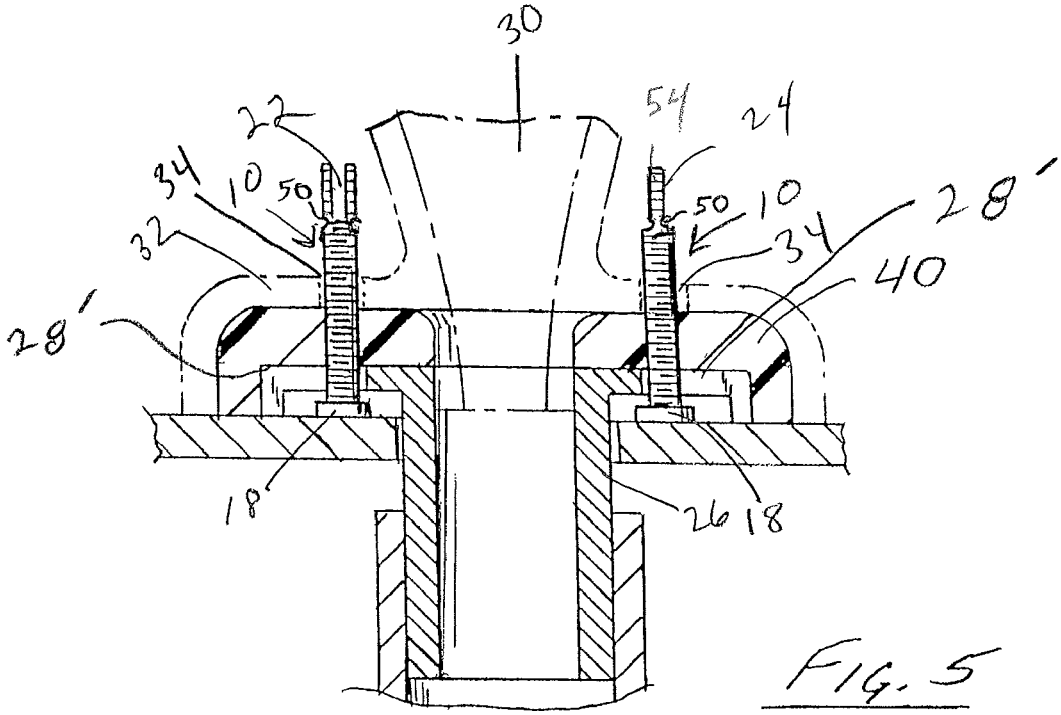
FIG. 5 is a cross-sectional view of a toilet installation showing the water closet bolt of FIGS. 1-4.
Figure 6:
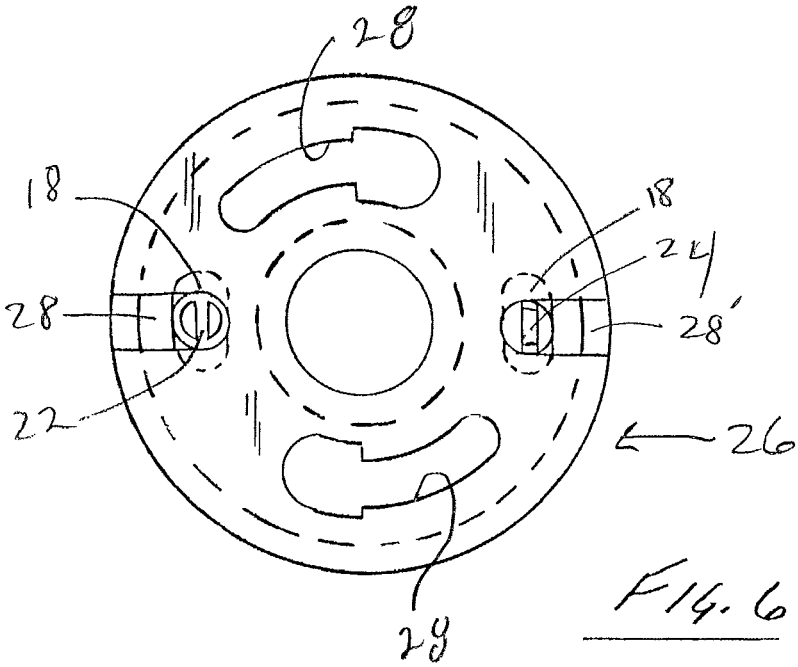
FIG. 6 is a top plan view of a closet collar used in the installation of toilet with the improved water closet bolt of FIGS. 1-5.

Turning now to FIGS. 5 and 6, a toilet assembly using the water closet bolt 10 of the present invention is shown. A closet collar 26 having slots 28 and 28' for insertion of water closet bolts 10 is shown. A toilet 30 is shown wherein the base 32 of the toilet 30 has two vertical apertures 34 through which closet bolts 10 are to be inserted. A sealing ring 40, typically formed of wax, is compressed between the closet collar 26 and the base 32.

Still referring to FIGS. 5 and 6, the closet collar 26 that rests on the floor where a toilet is to be installed is shown with the closet bolts 10 of the present invention inserted into one of two sets of slots 28 and 28' in the collar 26. The slots 28 are arcuate with an enlarged end. The slots 28' are notches extending radially inwardly from the outer perimeter of the collar 26. The bolt 10 can inserted into an arcuate slot 28 by insertion into the enlarged end of the slot 28 with the long axis of the foot 18 extending parallel to the slot 28, then moving the bolt 10 to the narrower area, and rotating the bolt 90° so that the long axis of the foot is perpendicular to the slot. The bolt 10 can be inserted into a radial slot or notch 28' by simply sliding it into the slot 28' from the outside and, if necessary, rotating the bolt 10 so that the long axis of the foot 18 is perpendicular to the slot 28'.

Still referring to FIGS. 5 and 6, a sealing ring 40, typically formed of wax, is then positioned over the collar 26 and bolts 10 so that the bolts 10 extend through the sealing ring. A base of a toilet 30 the base 32 is then mounted over the wax ring by inserting the upper ends 12 of the water closet bolts 10 through apertures 34 in the base 32 of the toilet. The notch 22 or 24 of the closet bolt 10 indicates to the user the orientation of the long axis of the oblong foot 18 of the closet bolt 10 so that the user is assured that the bolt did not slip out of position during installation.

Once the toilet 30 has been lowered onto the floor and into position, a nut 36 and washer (not shown) or similar fastener arrangement is threaded onto the water closet bole 10 from above. Because the threads extend all the way to the end of the bolt, the nut can be started onto the threads even if an unusually thick wax ring or other conditions initially leave only the extreme end of the bolt 10 exposed. The nut is tightened downwardly on the closet bolt 10 over the threaded body 16. The nut 36 is tightened downwardly against the base 32 of the toilet 30 so that the water closet bolt 10 is held securely against the bottom of the collar and the toilet 30 is clamped against the floor. The user can prevent the bolt 10 from turning during the later phases of the night tightening process by engaging the hold back surfaces of the notch 22 or 24 using the appropriate tool. This engagement is performed using a screwdriver or the like in the case of a female notch 22 and using a wrench or pliers in the case of a male notch 24. In either instance, the hold-back surfaces are substantially strong enough to withstand the torque required for a hold-back during installation but also weak enough so that an excess portion may easily be removed, as will be discussed further below. If necessary, the user can use the orientation of the notch as a guide to turn the bolt to assure optimum orientation just before the final tightening. Once the water closet bolts 10 are secured within the base 32, a cap (not shown), typically made of plastic or ceramic, is screwed or otherwise mounted over the exposed portion of the bolt 10.

The excess portion of the bolt 10 is typically too long for standard sized caps to fit over. Thus, the excess portion of the bolt 10 must be removed so that the cap may fit securely over the bolt and up against the base 32 of the toilet 30. The notch 20 of the bolt 10 provides a break-off point to ease the removal of an excess portion of the bolt. The break-off point is completely integrated with the notch 20 and the gripping surface of notch 20 so as to aid the installer in installation of the toilet 30. In the case of the female notch 22, the excess portion may be easily removed one end at time by inserting the head of a tool, such as a screwdriver, into the female notch 22. The installer then simply pulls the head of the tool towards one of the sides of the female notch 22 to substantially weaken the material adjacent the female notch end. The installer then moves the tool in the opposite direction to bend the material adjacent the other side of the notch. Once the one side of the portions adjacent the opposite side of the end of the female notch 22 are sufficiently bent, they may be easily removed with a pliers or similar tool. To aid in this process, the female notch 22 may, if desired, be located perpendicular to the long axis of the oblong foot 18 of the bolt 10, so that, when removing the excess portion of bolt 10, the elongated foot provides increased resistance to bolt tilting, reducing the risk that the bolt will tilt and chip the porcelain of the toilet 30.

In the case of the male notch 24, a pliers or similar tool may be used to remove the excess portion of bolt 10. Similar to the female notch 22, the male notch 24 may extend perpendicular to the long axis of the oblong foot 18 so that, during removal of the excess portion of bolt 10, the porcelain of toilet 30 is not as easily chipped as it would be if the notch extended parallel with the long axis of the oblong foot 18.

After the excess end portion of the bolt 10 is broken at the break off point, a standard cap (not shown) can be mounted over the bolt in any desired manner.

Many changes and modifications could be made to the invention without departing from the spirit thereof. The scope of some of these changes can be appreciated by comparing the various embodiments as described above. The scope of the remaining changes will become apparent from the appended claims.

We claim:

1. A water closet bolt for use in installing a toilet comprising:

A. an elongated bolt having an upper end and a lower end and having a threaded body extending therebetween;

B. a substantially oblong foot on the lower end of the bolt; and

C. a notch, extending downwardly from the upper end of the bolt, for visually indicating the orientation of a long axis of the oblong foot of the lower end of the bolt, wherein i. the notch forms a non-threaded surface that extends downwardly from the upper end of a threaded portion of the bolt and into the threaded body, the non-threaded surface serving as an at least substantially vertical hold back to aid in the installation of the toilet, ii. the notch terminates in a break-off point located at the bottom of the notch, the bolt being thicker and stronger immediately beneath the break-off point than at the break-off point, iii. the non-threaded surface is configured for gripping to enable tightening of a nut to the water closet bolt, and wherein iv. the break-off point is configured to enable the removal of an excess portion of the water closet bolt, wherein the water closet bolt further comprises a peripheral groove formed in the bolt at the break-off point at the bottom of the notch.

2. The water closet bolt of claim 1, wherein the notch is a female notch extending diametrically entirely across the bolt through an axial centerline thereof.

3. The water closet bolt of claim 1, wherein the notch is a male notch presenting opposed flat surfaces located diametrically opposite one another.

4. The water closet bolt of claim 1, wherein the notch is oriented perpendicularly to the long axis of the foot.

5. The water closet bolt of claim 1, wherein the notch is oriented parallel to the long axis of the foot.

6. The water closet bolt of claim 1, wherein the break-off point is located approximately 1¾" inches above a lower end of the threaded body.

7. The water closet bolt of claim 1, wherein the break-off point is located approximately 2 inches above a lower end of the threaded body.

8. The water closet bolt of claim 1, wherein the break-off point is located approximately 3 inches above a lower end of the threaded body.

9. A method of mounting a toilet comprising the steps of:

A. placing a closet collar having slots for insertion of water closet bolts on a floor where the toilet is to be mounted;

B. inserting water closet bolts in the slots of the closet collar, wherein each of the water closet bolts comprises, i. an upper end, a lower end, and a threaded body extending therebetween, ii. an oblong foot on the lower end of the bolt, and iii. a notch extending downwardly from the upper end of a threaded portion of the bolt and into the threaded body, the notch being configured to visually indicate the orientation of a long axis of the oblong foot, wherein the water closet bolt further comprises a peripheral groove formed in the bolt at the break-off point at the bottom of the notch;

C. positioning each of the water closet bolts so that the long axis of the oblong foot is transverse to a narrow axis of the slot;

D. lowering a toilet onto the closet collar so that the upper ends of the water closet bolts extend through the slots of the closet collar and apertures in a base of the toilet;

E. mounting a nut onto the threaded body of each of the bolts to clamp the toilet in place, each nut being threaded to a point beneath the bottom end of the notch in the corresponding bolt;

F. during at least a portion of the mounting step, engaging a non-threaded peripheral portion of the notch of each bolt to prevent the bolt from rotating, G. after the mounting step, breaking off each bolt at a break-off point located at the bottom end of the corresponding notch and above an upper end of the nut, each bolt being thicker and stronger immediately beneath the break-off point than at the break-off point; and (H) mounting a cap over the nut.

10. The method of mounting of a toilet of claim 9, wherein each notch is a male notch presenting opposed flat surfaces located diametrically opposite one another.

11. The method of mounting of a toilet of claim 9, wherein each notch is a female notch extending diametrically entirely across the associated bolt through an axial centerline thereof.

12. The method of mounting of a toilet of claim 9, wherein each notch is oriented perpendicular to the long axis of the oblong foot.

13. The method of mounting of a toilet of claim 9, wherein each notch is oriented parallel to the long axis of the oblong foot.

14. The method of claim 9, wherein the breaking step is performed with one of a screwdriver and a pliers.

15. A toilet assembly comprising:

A. a toilet having a base, said base having apertures therein;

B. a closet collar positioned underneath the base of the toilet and configured to rest on a floor, said closet collar having slots for communication with the apertures of the base of the toilet;

C. water closet bolts each having an upper end, a lower end, and an elongated threaded body extending at least part way therebetween, the bolts each having an oblong foot on the lower end, wherein a long axis of each oblong foot is configured to engage a lower surface of a corresponding slot of the closet collar and the upper end of each bolt is configured to extend through one of the apertures of the base of the toilet, each of the closet bolts additionally having a notch, extending downwardly from the upper end of a threaded portion of the bolt and into the threaded body, for visually indicating the orientation of the long axis of the oblong foot, wherein each notch further provides a surface to provide a hold back for an installer during installation and a break-off point, located at a bottom of the notch, at which the bolt can be broken to remove the notched upper end of the bolt, each bolt being thicker and stronger immediately beneath the break-off point than at the break-off point, wherein the water closet bolt further comprises a peripheral groove formed in the bolt at the break-off point at the bottom of the notch; and D. nuts that are threaded onto the bolts and that hold the base in place, each nut having a top surface located beneath the break-off point;

wherein the notch is configured for gripping to enable tightening of the retainers to a threaded body of the water closet bolt, and wherein the break-off point is configured to enable the removal of an excess portion of the water closet bolt.

16. The toilet assembly of claim 14, wherein each notch is a female notch extending diametrically entirely across the associated bolt through an axial centerline thereof.

17. The toilet assembly of claim 15, wherein each notch is a male notch presenting opposed flat surfaces located diametrically opposite one another.

18. The toilet assembly of claim 15, wherein the notch is oriented perpendicularly to the long axis of the oblong foot.

19. The toilet assembly of claim 15, wherein the notch is oriented parallel to the long axis of the oblong foot.

* * * * *